United States Patent [19]

Schwarz

[11] 4,340,354

[45] Jul. 20, 1982

[54] OIL BURNER

[76] Inventor: Anton Schwarz, Hohenstrasse 24a, Innsbruck, Austria, A-6020

[21] Appl. No.: 90,278

[22] Filed: Nov. 1, 1979

Related U.S. Application Data

[63] Continuation of Ser. No. 851,478, Nov. 14, 1977, abandoned.

[30] Foreign Application Priority Data

Nov. 12, 1976 [AT] Austria ..... 8460/76
May 2, 1977 [DE] Fed. Rep. of Germany ..... 2719573

[51] Int. Cl.[3] ..... F23N 1/00
[52] U.S. Cl. ..... 431/12; 431/41
[58] Field of Search ..... 431/11, 12, 41, 161, 431/208, 89; 239/135, 139

[56] References Cited

U.S. PATENT DOCUMENTS

| | | | |
|---|---|---|---|
| 1,509,072 | 9/1924 | Watts | 239/139 |
| 2,579,215 | 12/1951 | Te Nuyl . | |
| 2,625,211 | 1/1953 | Hill | 431/41 |
| 2,780,280 | 2/1957 | Allen | 431/41 X |
| 2,841,215 | 7/1958 | Messer | 239/135 X |
| 3,227,204 | 1/1966 | Dibert | 431/41 X |
| 3,326,262 | 6/1967 | Weller, Jr. et al. | 431/41 X |
| 3,467,480 | 9/1969 | Pfeiffer | 431/41 |
| 3,475,916 | 11/1969 | Smith | 431/41 X |

*Primary Examiner*—Samuel Scott
*Assistant Examiner*—Randall L. Green
*Attorney, Agent, or Firm*—McGlew and Tuttle

[57] ABSTRACT

Light fuel oil of low viscosity is supplied to a pressure atomizing oil burner. A flow heater which is positioned upstream of the pressure atomizing nozzle, preheats the fuel oil to a temperature of approximately 150° C. but not over the coking and cracking temperature of the fuel. With heat efficiencies up to approximately 25,000 kcal/hour density and viscosity are continuously decreased in the flow heater in order to reduce the thickness of the oil film leaving the atomizing nozzle and thus to decrease the flow rate.

With heat efficiencies higher than approximately 25,000 kcal/hour density and viscosity are decreased before the ignition phase by preheating, in order to reduce the thickness of the oil film flowing out of the atomizing nozzle and thus to decrease the flow rate in the following ignition phase. After the ignition phase the preheating is reduced or stopped.

1 Claim, 10 Drawing Figures

Fig. 8
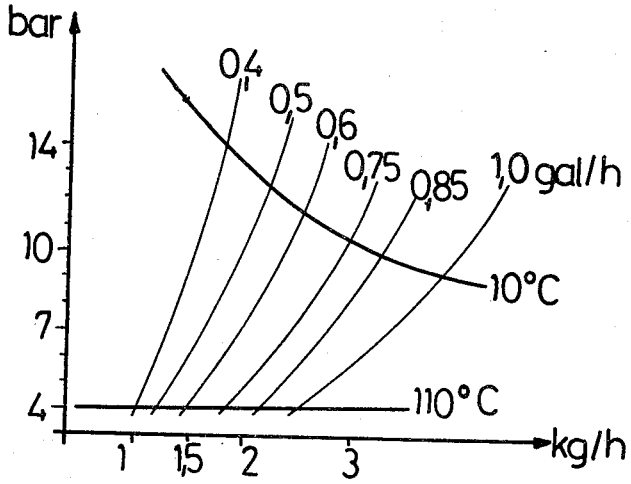
Fig. 9
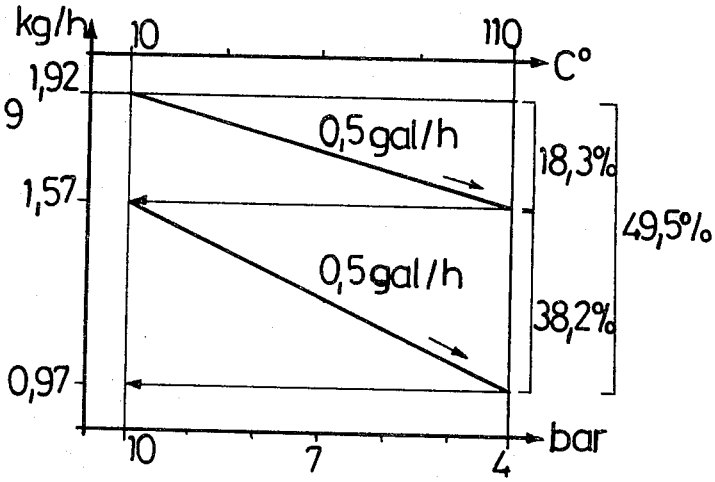
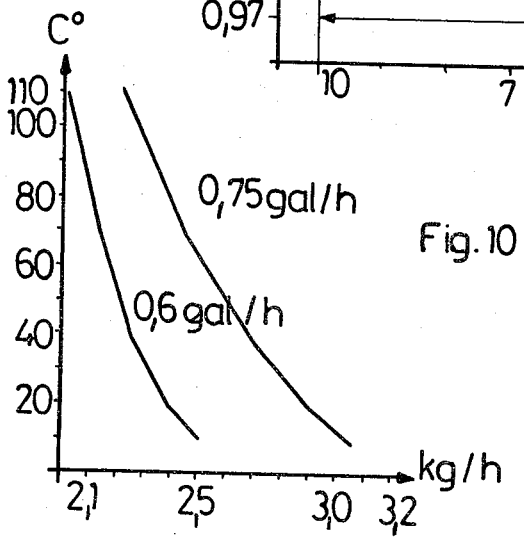
Fig. 10

OIL BURNER

This is a continuation of application Ser. No. 851,478 filed Nov. 14, 1977, now abandoned.

BACKGROUND OF THE INVENTION

1. Field of the Invention

The present invention relates to a pressure atomizing oil burner, which atomizes light fuel of low viscosity (below 12 centistoke at 20° C.) below the coking and cracking temperature of crackable components, as well as to processes for operating the oil burner.

2. Description of the Prior Art

Conventional oil burners frequently use the pressure atomizing principle. In this case the fuel oil is supplied to the pressure atomizing nozzle by a pump at a pressure of 10–14 bar. This pressure atomizing nozzle has a swirl chamber into which the fuel is fed by tangential channels so that it rotates in the swirl chamber an leaves it as an atomizing oil film.

For this kind of atomizing and only when using heavy or medium fuel of high viscosity, it has been usual to preheat the fuel before atomization in order to reduce viscosity and to make pressure atomization possible at all. For oil burners of the above-mentioned kind which burn light and superlight fuel oil, this preheating has not been necessary since light fuel oil has, at room temperatures, substantially lower viscosity than considerably preheated medium or heavy fuel and its use for operating the conventional relatively powerful pressure atomizers has been satisfactory. The desired burner capacity is determined by the size of the atomization nozzle. Especially in the case of low burner capacities which have only lately been requested and whose flow rate is less than 2 kg/h, difficulties concerning the quality of combustion and reliability have risen. These difficulties are due to the necessarily small cross-section of the nozzles used, since these nozzles may easily cause problems due to solid components of the fuel that may deposit at the inside walls of the outlet. The necessarily small cross-sections of the nozzles show a strong tendency to deterioration in atomization which could not completely be counter-balanced in spite of considerable pressure increase. In June 1977 these difficulties were still discussed in the German technical journal "Öl- und Gasfeuerung", for example, and it was decided that oil burners operated by the pressure atomizer process were not possible for low capacities and that different burning techniques by means of supersonics and the like, would have to be applied.

Different kinds of oil burners the gas atomizers could not help in overcoming the above-mentioned difficulties. Gas atomizers are known which preheat the fuel oil to temperatures of over 300° C. before combustion in order to achieve evaporation and stoichiometric combustion. For such vaporizing gas burners very expensive and powerful heating devices are necessary. The essential disadvantage, however, is the fact that the fuel oil must be heated to a far higher temperature than the coking or cracking temperature which is usually about 150° C. The thus produced tailings clog the heating device and occasionally the nozzle as well, so that this kind of oil burner cannot overcome the above-mentioned disadvantages, either.

SUMMARY OF INVENTION

It is, therefore, an object of the present invention to produce a pressure atomizing oil burner for light fuel as well as to find a process for its operation which guarantees high combustion efficiency and reliability for low burner capacities. It is a further object of the present invention to improve the starting properties of pressure atomizing oil burners for light fuel of low viscosity also in the case of higher burner capacities.

The invention is based on an oil burner which atomizes fuel oil of low viscosity which is below the coking and cracking temperature of crackable components and provides a flow-heater which is positioned upstream of the atomizing nozzle to preheat the fuel oil to a temperature of up to 150° C.

An oil burner of the above-mentioned construction allows a variety of new and advantageous fields of application. A preferred process for the operation of this oil burner for heat efficiency up to 25,000 kcal/h is characterized in that the viscosity and density of the light fuel are continuously reduced in the flow-heater by a pre-set rate, whereby the flow-rate by weight is decreased as compared to the flow-rate of an atomizing nozzle of the same cross-section supplied with unheated fuel oil.

The thus improved atomizing quality which is due to the reduced viscosity has the further advantage that the fuel oil can be supplied from as low a pressure as 2.5 bar and over, whereby a reduction of the flow-rate of up to approximately 60% is achieved.

The oil burner according to the present invention allows a process of combustion in which, for example, an atomizing nozzle which is designed for a flow-rate of 0.6 gallons/hour of unheated fuel can be operated by means of less heat efficiency, i.e. by a lower flow-rate of fuel per hour, than conventional nozzles which are designed for a flow-rate of 0.4 gallons/hour of unheated fuel. This means that by means of the oil burner according to the present invention lower burner capacities per hour can definitely be achieved than seemed to be possible up to now even in the case of extremely small cross-sections for the atomizing nozzle. This has the advantage that a nozzle which is dimensioned for a flow-rate of 0.6 gallons/hour of unheated fuel will be less effected by clogging and defects and that the atomizing quality will substantially be improved because of the reduced viscosity. This fact is of further importance with regard to the cost of maintenance and service. As the feed pressure of the light fuel, which is necessary for an impeccable atomizing, can be considerably reduced because of the improved atomizing quality, a substantial reduction of the combustion noise is achieved in addition to the subsequent and further reduced flow-rate. This advantage naturally also remains in the case of burner heat efficiencies which are higher than the one mentioned above since a correspondingly bigger nozzle can be chosen for the same heat efficiency.

It is a further advantage of the pre-heating of the light fuel, according to the present invention, that variations of the external temperatures which, up to now, considerably changed the temperature of the supplied fuel and consequently its viscosity, which subsequently caused considerable variations in the fuel-air-ratio and increased soot-deposit in the oil burner, have practically no more effect, because of the logarithmic temperature-dependent viscosity.

A preferred process for starting an oil burner for burner capacities above 25,000 kcal/h is characterized in that a heating device reduces viscosity and density of a part of the oil by preheating it to a preset temperature. After reaching this temperature the ignition phase, and thus atomization, starts, whereby the flow-rate by weight in this ignition phase is decreased as compared to the flow-rate of an atomizing nozzle of the same cross-section, supplied with unheated fuel oil. This process according to the present invention for starting an oil burner of greater heat capacity, allows a start which is substantially free of soot and excess pressure due to the initially lower fuel supply and improved atomizing. After the ignition-phase the flow-rate through the atomizing nozzle can be increased by reducing the pre-heating temperature.

It is advantageous if the flow-heater is positioned upstream adjacent the atomizing nozzle. It is of further advantage for the atomization if the fitting of the atomizing nozzle, the oil feeding pipe and the heating element form a connection of good heat-conducting characteristics. Thereby the atomizing nozzle, too, is already pre-heated.

It is also advantageous if the flow-heater has a preferably cylindrical heating element whose outer surface is surrounded by the oil-feeding pipe. In this embodiment the heating element is preferably surrounded by a block of good heat-conducting characteristics in which the oil-feeding pipe and a fitting for the atomizing nozzle are provided. Another preferred embodiment provides that the oil-feeding pipe is formed by recesses in the good heat-conducting block and at the interfaces with the heating element. It is furthermore preferred that the oil-feeding pipe forms a spiral around and in the longitudinal direction of the heating element. In this case the heating element is preferably shrink-fit into a bore of the block.

Particularly in the case of greater burner capacities it is of advantage if the oil-feeding pipe is an oil-bath surrounding the heating element.

It can be of further advantage if the oil-feeding pipe in the flow-heater has an inner surface which is enlarged by grooves or raised portions.

It is of further advantage if the flow-heater is provided with a thermostat which controls the source of energy of the heating element. Thereby a cold-start locking device can advantageously be provided which blocks the oil supply to the atomizing nozzle and oil-flow out of the nozzle by means of the thermostat before the pre-set temperature has been reached.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 8 shows the pressure to flow-rate dependency of different, conventional atomizing nozzles at different oil temperatures, FIG. 9 is a pressure to flow-rate diagram for an atomizing nozzle at different oil temperatures and pump pressures, and FIG. 10 shows the dependency of the flow-rate by weight on the temperature for two nozzles of different dimensions.

DETAILED DESCRIPTION OF THE PREFERRED EMBODIMENTS AND PROCESSES

Figure 1:
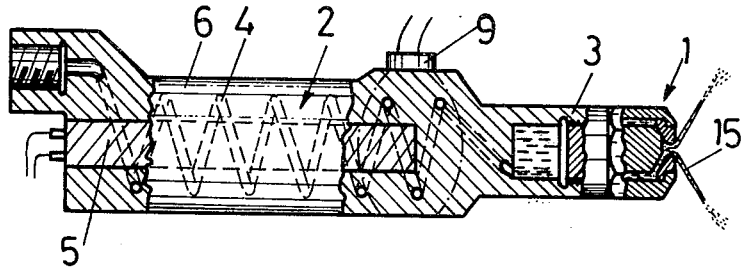
FIGS. 1 and 2 show side views of preferred embodiments of an oil burner partly in section, with an integrated flow-heater according to the invention.

FIG. 1 shows a partial cross-sectional view of an oil burner with integrated flow-heater. It consists substantially of a good heat-conducting block 6 which comprises an electric resistance-heating element in a central bore at its rear end and a nipple-type fitting 3 for the atomizing nozzle 1, at its front end. The block 6 has, furthermore, an oil-feeding pipe 4, which forms a longitudinal spiral around the heating element 5 and which ends tangentially in the fitting 3 for the atomizing nozzle. The block 6 can preferably be formed by coating a spirally wound copper pipe, which forms an oil-feeding pipe, with aluminium or a similar material. Furthermore, a thermostat 9 is provided on the block 6.

Figure 2:
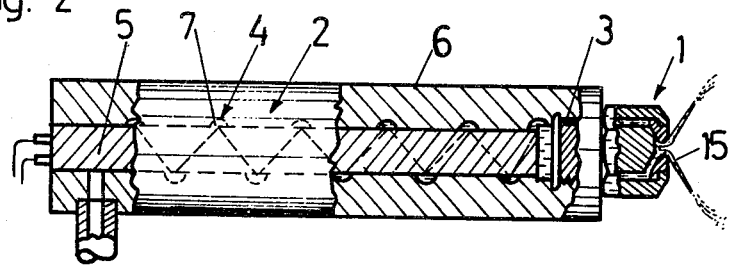

FIG. 2 shows a variant of the oil burner. The electric heating element 5 is preferably cylindrical and fitted into a good heat-conducting block 6 which is, for example, made of a brass tube. The oil-feeding pipe 4 is formed by recesses 7, which form a longitudinal spiral around the heating element 5, at the interface between the heating element 5 and the block 6, said pipe 4 thus ends tangentially in the fitting 3 for the atomizing nozzle which belongs to the front end of the block 6. The cost of production for such flow-heaters is extremely low, as the heating element 5 can be shrink-fitted in a leak-proof manner into the block 6. Due to a good heat-conduction on the entire surface of the recesses 7, a high specific heat transfer to the fuel oil is achieved.

Figure 3:
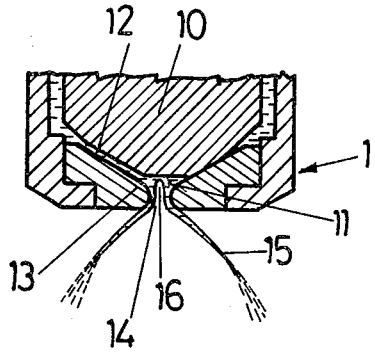
FIG. 3 shows a fractional sectional view of the atomizing nozzle and the behaviour of the oil film which is flowing out.

FIG. 3 shows a sectional view of a known pressure atomizing nozzle 1. It comprises a nozzle cone 10, a nozzle plate 13 with an outlet bore 14 and the feeding slots for the oil which are tangentially directed towards the swirl chamber 11. Due to this tangential oil supply the oil makes a rotary motion in the swirl chamber 11 and leaves the outlet bore 14 as a thin oil film 15 which approximately lies on the surface of a cone. This figure illustrates that an air core 16 is already formed in the outlet bore 14 of the atomizing nozzle due to the rotation of the oil film. This air core and the thickness of the oil film, in particular, is to a great extent influenced by the viscosity of the supplied oil. This fact can cause a change of the atomizing and combustion quality.

The embodiments of the invention illustrated in FIGS. 1 and 2 are particularly suitable for carrying out the new combustion process in the case of burners with a yellow combustion flame and low capacities.

Figure 4:
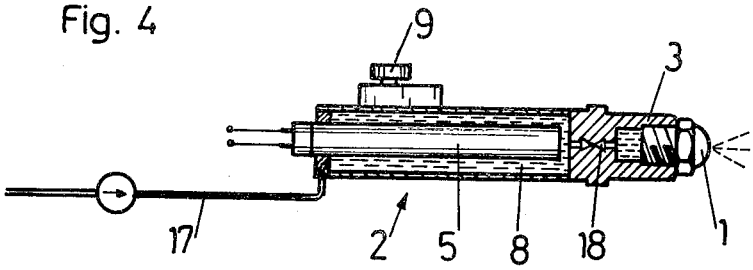
FIG. 4 shows a variant of an oil burner in which the oil-feeding pipe is an oil-bath surrounding the heating element.
Figure 5:
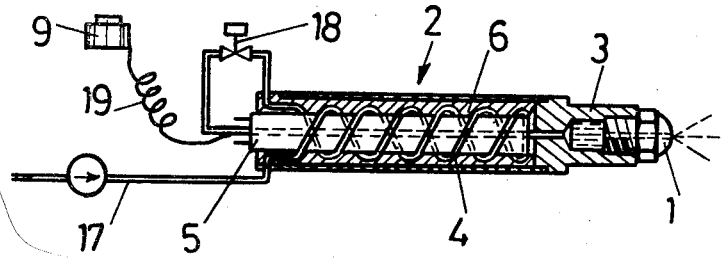
FIGS. 5 and 6 are schematic views of further embodiments of the invention.

FIG. 4 shows a schematic view of an oil burner which is suitable for the new starting process for oil burners with greater capacities. The oil-feeding pipe is an oil-bath 8 which surrounds the heating element 5. This oil-bath is connected with the fitting 3 for the pressure atomizing nozzle 1 by means of a connecting pipe having a closing valve 18. The oil-bath 8 is fed from an oil pump 20 by means of a fuel conduit 17. Furthermore, a thermostat 9 and the oil-bath 8 form a good heat-conducting connection. The oil burner illustrated in FIG. 5, which is equally suitable for great capacities, also has an electric heating element 5 which is spirally surrounded by the oil-feeding pipe 4 from the rear end to the front end and back again to the rear end and by a good heat-conducting block 6. Moreover, the runback end of the oil-feeding pipe 4 is connected with the fitting 3 and the atomizing nozzle 1 by means of electrovalve 18. Thereby a flowing out of the fuel oil from the nozzle is avoided during pre-heating, since the thermostat, as a cold-start locking device, releases the electrovalve 18 only after the desired pre-heating temperature has been reached. A thermostat which is connected with the flow-heater by means of a capillary tube 19 is furthermore provided.

Figure 6:
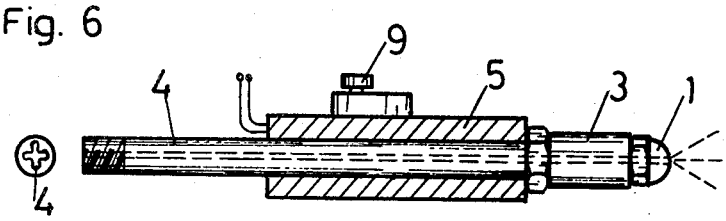

FIG. 6 shows a particularly simple embodiment. The heating element 5 is in this case a collar which encloses the oil-feeding pipe. In order to achieve a satisfactory heat transfer over a small mounting space, the oil-feeding pipe 4 has longitudinal grooves and raised portions on the inside in order to enlarge the surface.

As the fuel oil leaves the nozzles of any of the embodiments of the invention, the oil is ignited by known ignition means exemplified by 30 in FIG. 1.

Figure 7:
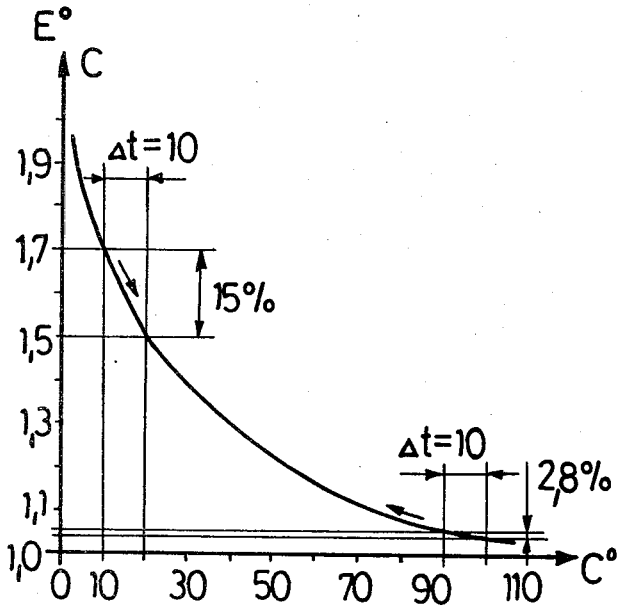
FIG. 7 shows the temperature dependent viscosity of a normal light fuel.

The above-described embodiments are well suitable for the new processes of combustion for fuel oil of low viscosity (as low as 12 Centistoke at 20° C.). FIG. 7 illustrates the temperature-dependent viscosity of such an oil. This oil has, for example, a viscosity of 1.7° E at a temperature of 10° C., whereas the viscosity drops to app. 1° E if the fuel oil has been pre-heated to a temperature of 110° C. Moreover, the density decreases and, thus, the volume of the fuel oil is increased by pre-heating. FIG. 8 is a diagram of the pressure flow-rate of a number of pressure atomizing nozzles which are designed for different flow-volumes per hour for unheated oil. This diagram illustrates that very high pressure is required to obtain impeccable atomizing quality, particularly in the case of small flow-volumes, when unheated oil, for example at about 10° C., is supplied. For this reason conventional oil burners need, for example, for a flow of 1.8 kg per hour of unheated fuel oil, an atomizing nozzle which was designed for 0.4 gallons/h at an operating pressure of about 14 bar. By using the oil burner according to the invention a pressure atomizing nozzle which is designed for 0.75 gallons/h of unheated fuel oil can be used for said flow of 1.8 kg/h if the fuel oil has been preheated to a temperature of about 110° C. before being atomized and an operating pressure of about 4 bar already guarantees sufficient reliability. The same characteristics occur in the case of all other cross-sections of the nozzle. As already mentioned, the preheating according to the present invention does not only guarantee greater reliability because of the relatively bigger cross-section of the nozzle, but also reduces noise substantially because of reduced pump-pressure.

FIG. 9 illustrates the advantages of the measures according to the present invention. In the case of a constant pump pressure of 10 bar the flow per hour for a pressure atomizing nozzle, which is designed for 0.5 gallons/h, drops from 1.92 kg to 1.57 kg if the oil is heated from 10° C. to 110° C. This corresponds to a flow reduction by weight of 18.3% and is the result of certain factors, as volume is increased, viscosity is decreased, the air core is increased due to the fast rotating movement in the swirl chamber of the atomizing nozzle and the thickness of the outflowing oil film is reduced. Due to the improved atomizing quality which has been obtained by preheating to 110° C., it is possible to reduce pump pressure from 10 bar to 4 bar. Thereby the flow per hour is further reduced from 1.57 kg to 0.97 kg which corresponds to a reduction of further 31.2%.

A total flow reduction of 50% can be observed. Thus, it is possible to use a far more reliable pressure atomizing nozzle which is designed for 0.75 gallons/h instead of an atomizing nozzle which is designed for 0.4 gallons/h of unheated fuel oil.

FIG. 10 shows diagrams of the temperature flow-rate by weight for two further different pressure atomizing nozzles at relatively high operating pressures. With these nozzles the flow-rate by weight per hour is considerably reduced and atomizing is at the same time considerably improved. It is a further advantage of the oil-preheating according to the present invention that variations of the external temperatures which considerably changed the temperature of the supplied oil and thus its viscosity, and which caused again substantial changes of the air-fuel-ratio in the oil burner, are practically no longer of any consequence because of the logarithmic temperature-dependent viscosity. This fact can be illustrated in the diagram of FIG. 7 which shows that a temperature decrease from 20° C. to 10° C. caused a change of viscosity of 15%, whereas, for example, a temperature decrease of 10° C. caused a change of viscosity of 2.8% when the oil was preheated to 100° C. If preheating is controlled by a thermostat, changes of viscosity can be completely avoided.

The present invention has further substantial advantages with regard to conventional oil burners that so far seemed to give satisfactory combustion of hourly oil flow-rates of about 2.5 kg and over.

This is caused by the fact that in the case of conventional oil burners, which usually run over a short period, the atomizing nozzle is supplied with oil of relatively high viscosity during the starting process because of the cooling-off during stopping periods, and by the fact that the subsequent heating causes a change of the fuel-air-ratio and causes substantial soot deposit. The present invention avoids this disadvantage especially by using a new operating process which can preferably be carried out by means of the embodiment of the oil burner as illustrated in FIG. 4. Thereby viscosity and density of the fuel oil are reduced by preheating before atomizing. When the desired preheating temperature has been reached valve 18 can be opened by means of thermostat 9 so that during the subsequent ignition-phase the fuel oil flows out of the atomizing nozzle at a lower flow-rate by weight than the cross-section of said nozzle would allow if unheated oil were supplied. Thus heavy soot depositing during the starting process can be avoided, as it is the case with conventional oil burners. Pressure excess during starting operations can extensively be avoided also. Once the oil burner has been started, it is possible to increase the flow-rate by weight to the desired burner capacity preferably by reducing or completely stopping the preheating.

If the heating element is suitably dimensioned, the desired weight increase can be achieved merely by the fact that the oil temperature drops after the opening of locking valve 18.

A further number of operating processes for oil burners, that is of different variants of oil burners, which are adapted to operating requirements, are naturally possible without leaving the scope of the present invention.

I claim:

1. A method of controlling the heat output of an oil burner by having a first nominal heat output for a first flow rate and changing to a reduced second output for a second flow rate, the oil burner burning light fuel oil of up to 12 centistoke at 20° C. viscosity in the oil burner, the oil burner having an atomizing nozzle for atomizing the light fuel oil when it is supplied to the nozzle under pressure and for a heat capacity of less than 20,000 kcal/h, the nozzle being of the type which has a swirl chamber with an outlet bore for atomizing the light fuel oil into a conical spray with central air core and designed for flow rates of between 0.4 and 1.0 gal/h, the method comprising:

heating the light fuel oil at a location immediately upstream of the swirl chamber of the atomizing nozzle to a temperature between 100° C. and 150° C. and below the cracking and coking temperature of the oil to continuously reduce the viscosity and density thereof to less than 2 centistoke;

feeding the heated light fuel oil through the atomizing nozzle under a pressure of between 2.5 and 12 atm;

controlling the flow rate by weight of the light fuel oil by heating so that the flow rate by weight thereof is decreased by up to 60% to the second flow rate as compared with the first flow rate through the atomizing nozzle supplied with the unheated light fuel oil; and igniting the light fuel oil after it has passed through the atomizing nozzle.

* * * * *